US005966821A

United States Patent [19]

Armbruster et al.

[11] Patent Number: 5,966,821

[45] Date of Patent: Oct. 19, 1999

[54] STORAGE CANISTER FOR ELECTRIC RAZOR AND SHAVING ITEMS

[76] Inventors: Joseph M. Armbruster; Sue B. Armbruster, both of 2700 NE. 47 St., Lighthouse Point, Fla. 33064

[21] Appl. No.: 09/005,820

[22] Filed: Jan. 12, 1998

[51] Int. Cl.[6] ..... B26B 21/40

[52] U.S. Cl. ..... 30/537; 30/34.05; 242/400.1; 320/115

[58] Field of Search ..... 30/34.05, 296.1, 30/298.4, 537, DIG. 1, DIG. 2, 43.9, 541; 242/400.1; 206/351; 320/115

[56] References Cited

U.S. PATENT DOCUMENTS

| | | | |
|---|---|---|---|
| 390,089 | 9/1888 | McClelland . | |
| 1,887,123 | 11/1932 | Flintermann . | |
| 2,778,486 | 1/1957 | Carissimi | 30/537 |
| 2,787,053 | 4/1957 | Kleinman | 30/41 |
| 2,918,228 | 12/1959 | Waller | 242/85.1 |
| 3,021,087 | 2/1962 | Rudolph | 242/400.1 |
| 3,389,323 | 6/1968 | Jepson et al. | 30/34.05 |
| 3,447,058 | 5/1969 | Stahly et al. | 30/43.9 |
| 3,476,331 | 11/1969 | Green, Jr. et al. | 242/85.1 |
| 3,562,905 | 2/1971 | Rakocy et al. | 30/34.05 |
| 3,633,089 | 1/1972 | Dorion, Jr. et al. | 30/34.05 |
| 4,253,013 | 2/1981 | Mabuchi | 30/537 |
| 5,138,245 | 8/1992 | Mattinger et al. | 320/115 |
| 5,318,356 | 6/1994 | Shelton | 30/537 |
| 5,379,903 | 1/1995 | Smith | 211/13 |

*Primary Examiner*—Hwei-Siu Payer
*Attorney, Agent, or Firm*—Jacobson, Price, Holman & Stern, PLLC

[57] ABSTRACT

A storage canister for a rechargeable electric razor and related shaving items including a base having an upper surface with a plurality of recesses formed therein for receiving and stably supporting an electric razor and a plurality of shaving items and a vertically extending cover or enclosure removably mounted on the base for enclosing the electric razor and shaving items when the cover or enclosure is in place on the base and providing easy access to the razor and shaving items when the cover or enclosure is lifted off the base. The storage canister base includes a bottom surface which can be placed on any convenient supporting surface adjacent to or contiguous with a bathroom lavatory sink such as a countertop surface. A recess in the bottom surface of the base includes a stationary spool on which excess DC power cord connecting a recharger with contacts in the razor receiving recess can be wound. The storage canister provides a functionally effective retainer and support for the razor and shaving items to retain them in an easily accessible position and in a small concentrated area or space so that a minimum space on a countertop surface is occupied.

12 Claims, 3 Drawing Sheets

STORAGE CANISTER FOR ELECTRIC RAZOR AND SHAVING ITEMS

BACKGROUND OF THE INVENTION

1. Field of the Invention

This invention relates to a storage canister for a rechargeable electric razor and related shaving items including a base having an upper surface with a plurality of recesses formed therein for stably receiving and supporting the razor and a plurality of shaving items and a vertically extending cover or enclosure removably mounted on the base for enclosing the razor and shaving items when the cover or enclosure is in place on the base and providing easy access to the razor and shaving items when the cover or enclosure is lifted off the base. One of the recesses in the base includes contacts to electrically connect the battery charger to the rechargeable batteries in the razor handle. The bottom surface of the base includes a stationary spool on which the DC power cord from the charger is wound. A recess in the bottom surface of the base receives the spool and cord. The storage canister base can be placed on any convenient supporting surface adjacent to or contiguous with a bathroom lavatory sink such as a countertop surface. The recesses in the base are shaped not only to receive the razor but also shaving items including at least one or more rollerball applicators or a razor cleaner or deep skin cleanser. The storage canister provides a functionally effective retainer and support for the razor and shaving items to retain them in an easily accessible position and in a small concentrated area or space so that a minimum space is consumed or occupied on a countertop or the like as compared to such items being randomly placed on a supporting surface or in a cabinet, drawer or the like. Also, the storage canister provides an attractive bathroom accessory due to a uniquely attractive shape and external surface appearance characteristics.

2. Description of the Prior Art

Electric shaving items, such as a rechargeable razor, a supporting and recharger device for the razor, preshaving and after shaving lotions and razor cleaners are frequently stored in a random fashion on a countertop supporting surface, on a shelf in a wall cabinet or in a drawer located in the bathroom. If the shaving items are merely placed on a countertop, they occupy or consume a large space, are unsightly, subject to becoming misplaced and possibly causing injury to users of the bathroom. When stored in a cabinet or drawer, shaving items frequently become entangled with other items and, in some instance, are difficult to locate. The charger which plugs into an electrical outlet and the DC supply cord to the razor also present a storage problem as excess cord may become entangled with other bathroom items.

Conventional shaving item packaging does not include a storage canister structure as incorporated into the present invention and which includes a base structure having a plurality of recesses receiving multiple shaving items in a vertical orientation combined with a removable cover concealing and protecting the shaving items. One of the recesses is provided with contacts connected electrically with the charger through a DC power cord. Excess length of the cord is stored on a spool built into a recess in the bottom surface of the base. The base and cover are generally cylindrical for occupying or consuming minimum countertop space as compared with independent shaving items. The upper end of the cover is curved or generally semispherical with the external surface of the storage canister incorporating uniquely attractive appearance characteristics.

SUMMARY OF THE INVENTION

An object of the present invention is to provide a storage canister for a rechargeable electric razor and related shaving items supported in a vertical position on a supporting base with a removable cover enclosing the razor and shaving items and telescopically engaging an upper portion of the supporting base to enable easy removal and replacement of the cover to provide access to the razor and shaving items when desired and to conceal and protect the razor and shaving items when the cover is in place thereby maintaining the razor and shaving items in a minimum space and in a readily accessible position with the storage canister providing an attractive unit which can be supported on a horizontal supporting surface such as a countertop in a bathroom or the like. The base also provides a spool in the bottom surface for storage of excess length of a power cord.

Another object of the invention is to provide a storage canister for shaving items in which the base includes a plurality of vertically extending recesses or sockets shaped to receive and position a lower end portion of a vertically disposed electric razor and shaving items to enable them to be self supporting on the base in order for such items to consume minimum countertop space and to enable the cover to be easily assembled on the base and removed from the base while the razor and shaving items remain supported in the recesses on the base.

A further object of the invention is to provide a storage canister for a rechargeable electric razor and related shaving items as set forth in the preceding objects in which the base is provided with contacts in the recess which receives the rechargeable razor with a DC power cord connecting the contacts in the canister to a charger.

Still another object of the invention is to provide a storage canister in which the bottom surface of the base includes a recess having a center spool therein on which the DC power cord is wound. The tag end of the power cord enters the spool and is connected to battery charging terminals or contacts which are engaged by the conductive pins or contacts on the electric razor. A clear plastic disc is mounted stationarily on a center pin with the periphery of the disc spaced from the periphery of the base to enable excess length of the DC power cord to be wrapped on the spool.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
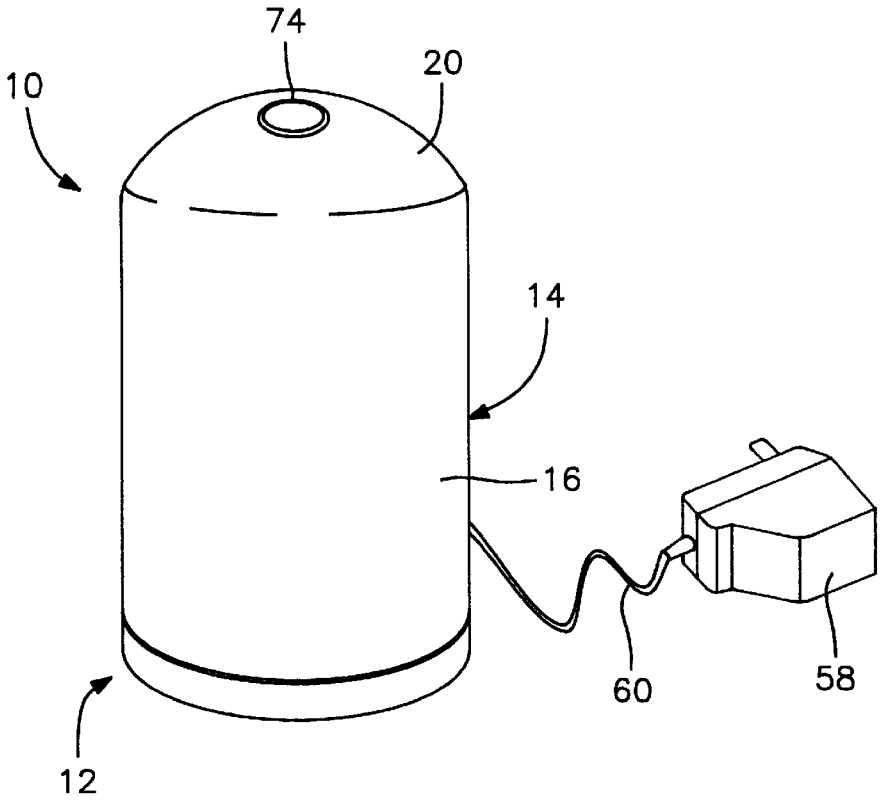
FIG. 1 is a perspective view of the storage canister for a rechargeable razor and related shaving items of the present invention with the cover in place and charger unplugged.
Figure 2:
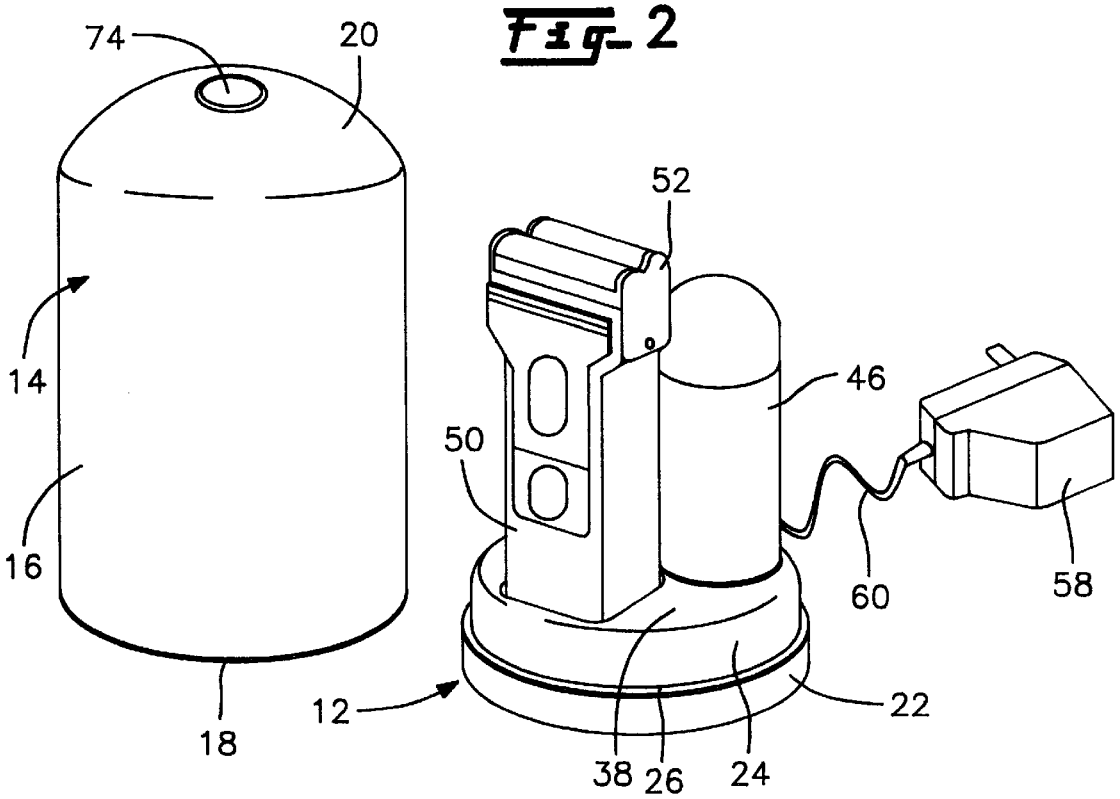
FIG. 2 is a perspective view of the storage canister similar to FIG. 1 with the cover removed from the base.

Although only one preferred embodiment of the invention is explained in detail, it is to be understood that the invention is not limited in its application to the details of construction and the arrangement of components set forth in the following description or illustrated in the drawings. The invention is capable of other embodiments and of being practical or carried out in various ways. Also, in describing the preferred embodiment, specific terminology will be resorted to for the sake of clarity. It is to be understood that each specific term includes all technical equivalents which operate in a similar manner to accomplish a similar purpose.

The storage canister of the present invention is generally designated by reference numeral 10 and includes a base 12 and a vertically extending removable cover or enclosure 14 with both components generally being of cylindrical configuration and extending vertically with the cover or enclosure 14 being defined by a relatively thin peripheral wall 16 defining a hollow interior and including a bottom edge 18 oriented in a horizontal plane. The upper end of the cover or enclosure 14 is curved or semispherical as indicated by reference numeral 20.

The base 12 includes a cylindrical peripheral wall 22 having an inwardly offset upper end portion 24 which defines a horizontal upwardly facing shoulder 26. A horizontally disposed upwardly bowed top wall 38 is oriented at the upper end of the base. The top wall 38 includes a pair of generally cylindrical recesses 40 and 42 offset from the center of the base and a generally square recess 44 extending generally equally tangentially to the recesses 40 and 42.

Figure 3:
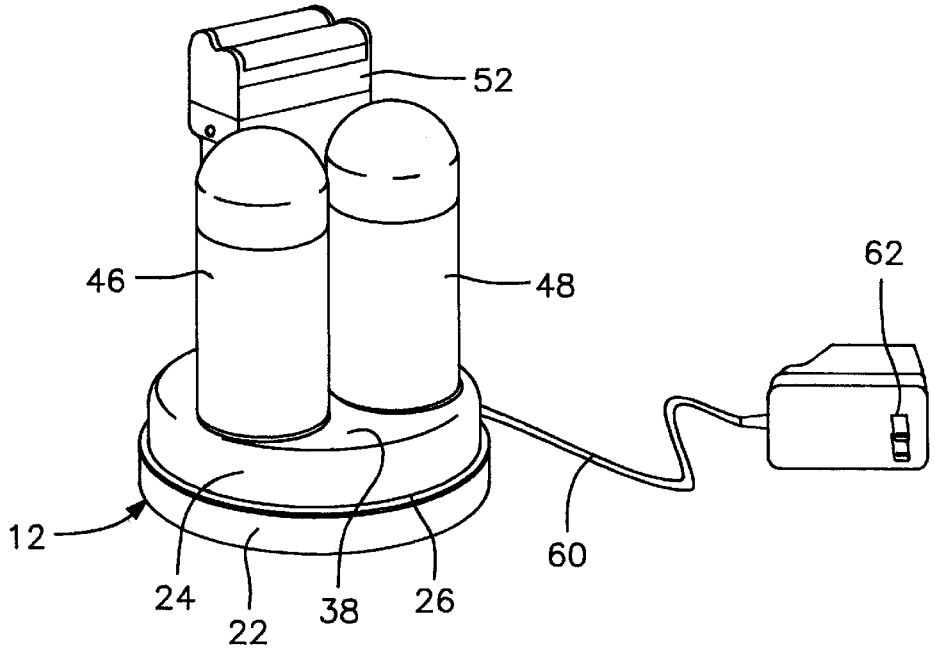
FIG. 3 is a perspective view similar to FIG. 2 taken from an opposite side of the base.
Figure 4:
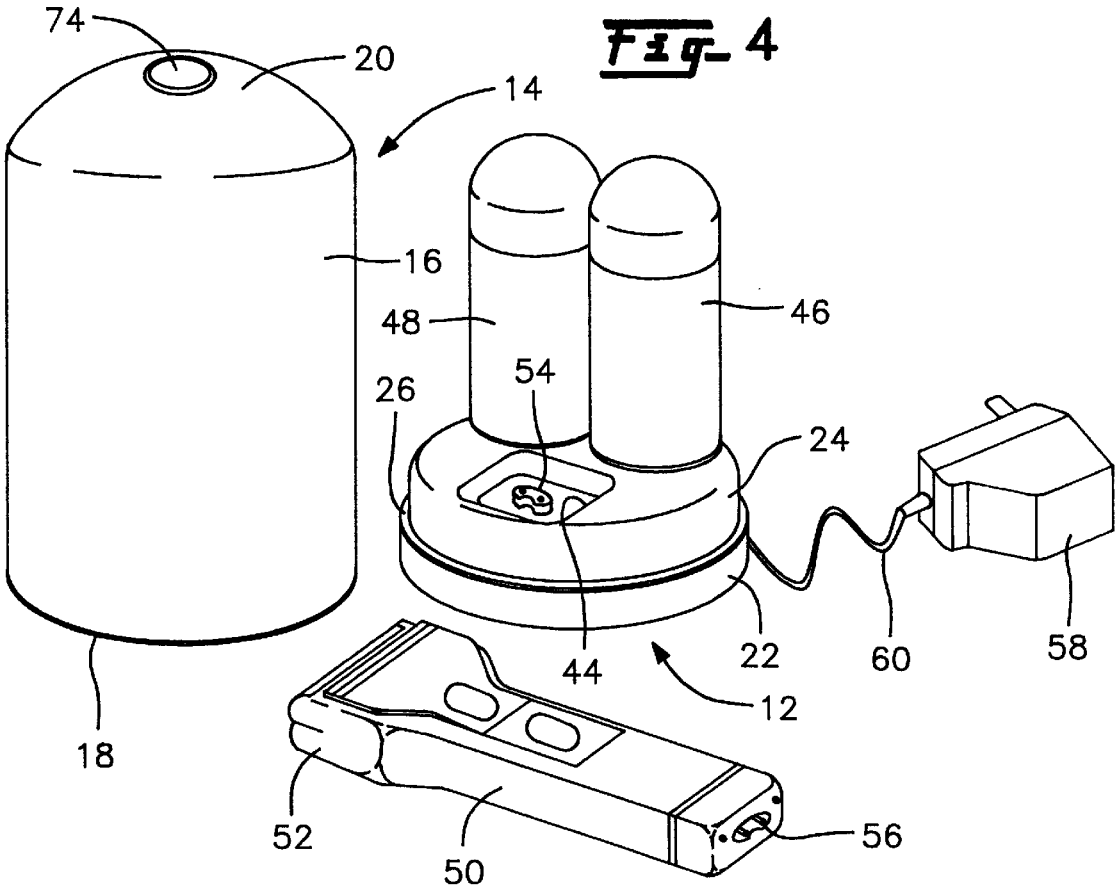
FIG. 4 is a perspective view similar to FIG. 2 with the razor removed to illustrate the recharging contacts.
Figure 5:
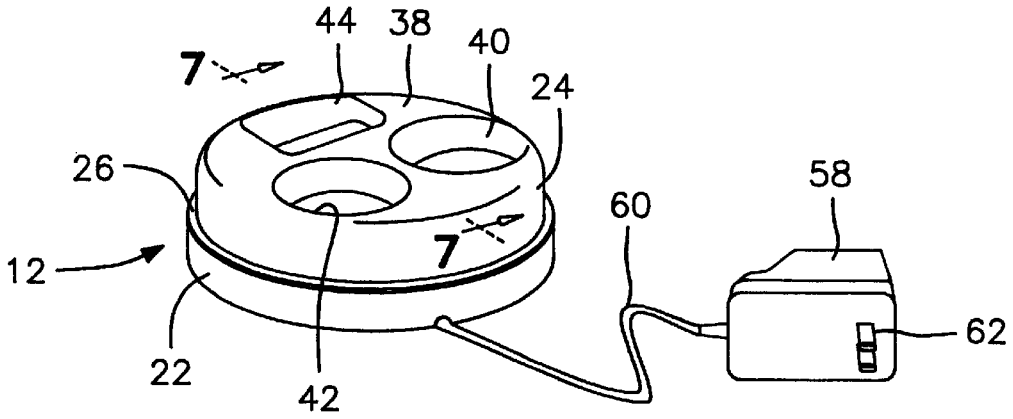
FIG. 5 is a perspective view of the base of the storage canister and the charger.

The recesses 40 and 42 are adapted to receive a container or containers of a shaving lotion applied to the surface to be shaved prior to shaving with an electric razor or a razor cleaner or a deep skin cleanser. The applicators are rollerball applicators as illustrated in FIG. 3 and designated by reference numerals 46, 48. Other applicators may be used such as a pressurized container of razor cleaner or a deep skin cleanser stored in a separate container. The recess 44 is shaped to receive the generally square handle 50 of a rechargeable electric razor 52. The recess 44 also includes electrical contacts 54 which will contact the contact pins 56 in the base of the razor in order to connect an electric charger 58 to the rechargeable batteries in the razor handle 50 through a flat flexible DC power cord 60.

Figure 6:
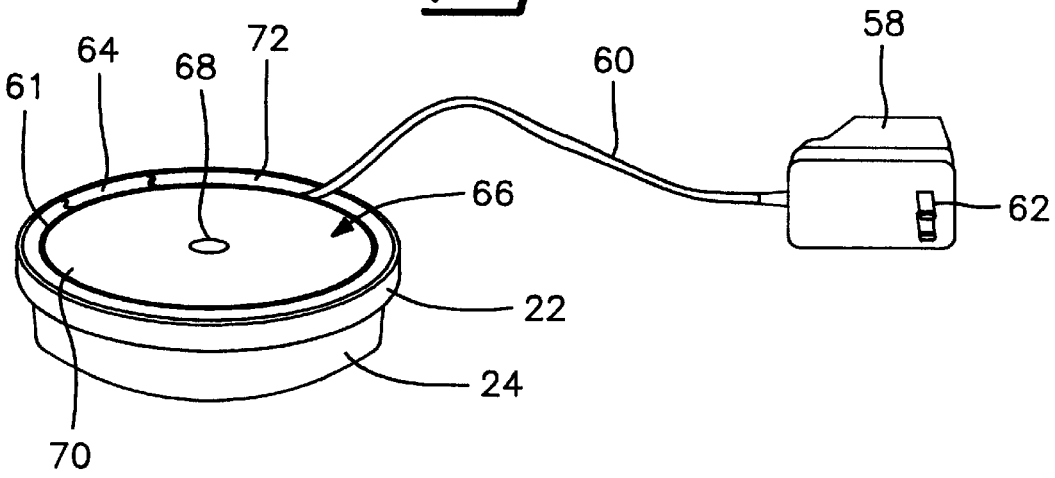
FIG. 6 is a bottom perspective view of the base illustrating the structure of the cord spool.
Figure 7:
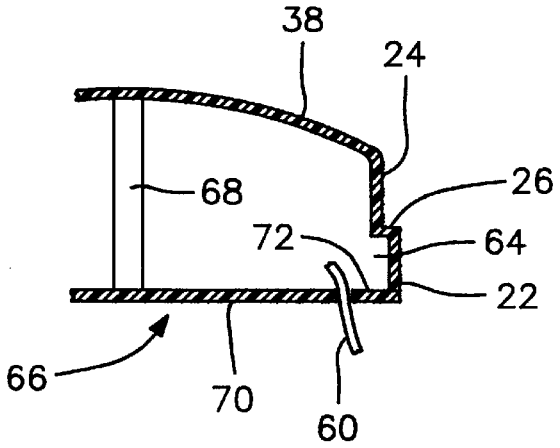
FIG. 7 is a transverse sectional view of the base taking along line 7—7 of FIG. 5 illustrating the recess and spool for storing excess power cord.

As illustrated in FIG. 3, the charger 58 includes male plug prongs 62 for insertion into a wall socket or the like. The DC power cord 60 supplies DC electrical energy to the contacts 54 and is received in a recess 64 in the bottom surface of the base 12 as illustrated in FIG. 6. The recess 64 includes a spool generally designated by reference numeral 66 and includes a central pin 68 stationary with the inner surface of the recess 64 and a stationary transparent plastic flange or disc 70 of polypropylene mounted on the lower end of the support pin 68 which has a periphery slightly spaced from the periphery of the base with a sufficient clearance to enable the supply cord 60 to be wound on the pin 68 inwardly of the flange 70 by moving the cord 60 in a circular path around the peripheral edge of the flange 70. The space between the flange 70 and the periphery of the recess in the base is provided with a flexible rubber or plastic annular ring 72 in the form of a flexible resilient member which will enable the cord to be wound onto the spool and unwound therefrom with the inner peripheral edge of the resilient rubber ring 72 and the outer edge of the flexible resilient flange 70 defining a slot 61 which provides frictional engagement with the cord 60 so that it is frictionally retained in a position by the outer periphery of the flange 70 and the inner periphery of the rubber ring 72 with this structure enabling the cord to be wound onto or unwound from the spool thereby enabling excess cord to be wound onto the spool and eliminate the excess cord from becoming entangled with other items in the bathroom, on the countertop or the like. The rubber ring 72 also forms a non-slip member on the bottom edge of the wall 22 to reduce the possibility of the canister base sliding on a smooth surface.

The canister is preferably constructed of plastic and can hold two rollerball applicators, one for regular prepost shaving lotion and the other with a prepost deodorant shaving lotion for underarms and bikini line shaving. Alternatively, one shaving lotion applicator and a razor cleaner solution or deep skin cleanser container may be placed in the recesses. The contacts engaging with the electric razor enables continuous regulated charging for the razor batteries when the charger is plugged into an electrical outlet. The shape and configuration of the canister may vary but preferably, it is approximately 4 inches in diameter and 6¾ inches in height. The spool in the base of the charger is capable of receiving approximately 36 inches of flat DC power cord. The tag end of the cord enters the spool and is connected to battery charging contacts or terminals in the recess 44. The power cord is held in place by a ⅛ inch thick clear polypropylene plastic disc and the clearance between the canister base, the flexible plastic disc and the rubber ring enables the cord to enter and exit from the recess. The resilient flexible ring also serves to retain the canister in position when it is supported on a supporting surface. Approximately 30 inches of the power cord can be left off the reel to enable the canister to be positioned in a desired position and any excess cord can be wrapped around the spool so no excess power cord is draped over the countertop thereby providing a neat, clean positioning of the canister without any excess cord. The rubber ring provides a nonskid feature to the canister and also prevents any marring of the surface on which the canister is supported. The rubber ring is attached with glue or it can be secured in any suitable manner to the bottom edge of wall 22 which forms the recess in the base. The razor terminals or contacts in the recess 44 can be flat or spring-type and rely on the weight of the razor to push it down for the flat contacts to contact the razor terminals. The particular type of female and male connectors in the base and in the razor may vary. A divider may be placed between the contacts to insure that the razor can only be positioned in one way to avoid incorrect placement thereby insuring proper positive/negative polarity because the razor will only install in one way. An alternative method of conducting charging current to the rechargeable batteries is by induction and in this method, the razor can be installed without any concern regarding correct polarity.

As illustrated, the upper end of the cover 14 includes a medallion or button 74 which fits into a slight recess and is used to cover the sprue that is cut off after the cover has been molded. In molding, the injected plastic must fill from the center, thus leaving a sprue, since the cover cannot be filled from the open end and maintain asthestic value. The medallion button fits on and is held in place with adhesive.

Also the canister and cover can vary in dimensions depending on the construction of the razor. The previously mentioned canister dimensions is used with the tallest version of the electric razor and other style razors may enable the canister to be slightly less in height. The charger also may include a miniature light that indicates charging with the charging circuit being automatically turned off when the batteries reach full charge.

The storage canister 10 can be provided with any desired distinctive external color or design ornamentation compatible with the decorative motif of the countertop or other bathroom surfaces on which the storage canister may be placed. The storage canister provides an attractive storage area which is small but sufficient to support the electric razor and shaving items on a countertop without consuming a large surface area of the countertop. The storage canister also provides immediate access to the electric razor and shaving items when desired and effectively retains all of the shaving items in a vertical, generally parallel relationship to each other and to the components of the storage canister and provides a bathroom accessory that has a unique appearance and functions effectively to support and conceal the electric razor and shaving items.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A rechargeable electric razor and support, said support comprising a base having a peripheral wall and a generally horizontal top wall, said top wall including at least one upwardly opening recess defined by a horizontal bottom surface and upstanding peripheral surfaces closely receiving and stably supporting a vertically disposed rechargeable electric razor removably in said recess, said base including a downwardly opening recess in a bottom surface thereof, a stationary spool in said recess in said bottom surface of the base, a recharging power cord connected to the upwardly opening recess in the top wall and extending through the recess in the bottom surface of the base to enable the cord to be wound on said spool.

2. The razor and support as defined in claim 1 wherein said spool includes a bottom flange of flexible resilient material having a periphery in spaced concentric relation to a periphery of said downwardly opening recess, the space between the periphery of the flange and periphery of said downwardly opening recess enabling the cord to be wound onto and off said spool.

3. The razor and support as defined in claim 2 together with a rigid cover having a bottom edge supported on said base to conceal and protect the razor.

4. The razor and support as defined in claim 3 wherein said base and cover are of cylindrical configuration for occupying a minimum space on a countertop surface.

5. The razor and support as defined in claim 2 wherein the periphery of said downwardly opening recess includes a flexible resilient flat ring mounted on a lower end of the base to provide frictional engagement with a supporting surface, said ring including an inner periphery in close concentric alignment with the periphery of the flange to resiliently grip the cord to retain the cord on the spool.

6. The razor and support as defined in claim 2 wherein said flange is constructed of transparent, plastic material.

7. A storage canister for an electric razor comprising a base having a bottom surface for positioning on a generally horizontal support, said bottom surface of the base including a downwardly opening recess, said recess including a stationary spool on which an electric supply cord can be wound, said base including an upwardly opening recess for receiving an electric razor, said spool including a centrally disposed support connected to the base and extending downwardly in the downwardly opening recess and a circular flange on a lower end of the support, said flange having a periphery spaced from a periphery of the downwardly opening recess sufficient to enable a flexible power cord to be wound on the spool.

8. The storage canister as defined in claim 7 wherein said base includes a cover, said base and said cover being cylindrical with the diameter of the storage canister being substantially less than its height.

9. The storage canister as defined in claim 8 wherein said cover includes a generally semispherical upper end.

10. The storage canister as defined in claim 7 wherein said base includes a plurality of outwardly opening recesses in an upper surface to receive shaving items used in conjunction with an electric razor.

11. The storage canister as defined in claim 10 wherein at least one of said recesses in the upper surface of the base is cylindrical for closely telescopically receiving a cylindrical lotion applicator.

12. The storage canister as defined in claim 7 wherein said recess for receiving the razor includes contacts for engaging contacts on the razor when the razor is positioned in the recess, said electric razor including rechargeable batteries connected with the contacts on the razor, said contacts in the recess being connected to said supply cord, said cord being connected to a charger for recharging said razor.

* * * * *